US010555085B2

(12) United States Patent
Salvatti et al.

(10) Patent No.: US 10,555,085 B2
(45) Date of Patent: Feb. 4, 2020

(54) HIGH ASPECT RATIO MOVING COIL TRANSDUCER

(71) Applicant: Apple Inc., Cupertino, CA (US)

(72) Inventors: Alexander V. Salvatti, Morgan Hill, CA (US); Onur I. Ilkorur, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/625,302

(22) Filed: Jun. 16, 2017

(65) Prior Publication Data

US 2018/0367918 A1 Dec. 20, 2018

(51) Int. Cl.
*H04R 7/24* (2006.01)
*H04R 9/06* (2006.01)

(52) U.S. Cl.
CPC ..... *H04R 9/06* (2013.01); *H04R 7/24* (2013.01)

(58) Field of Classification Search
CPC .. A61B 5/055; H02J 7/025; H02J 7/02; H04R 1/44; H04R 9/025; H04R 9/04; H04R 9/045; H04R 9/06; H04R 1/02; H04R 1/2896; H04R 1/00; H04R 1/28; H04R 3/00; H04R 7/20; H04R 7/24; H04R 7/125; H04R 9/02; H04R 31/00; B06B 1/06
USPC ..... 181/167, 177, 168, 170; 310/12.16, 13; 324/240, 318; 360/265; 369/13.14; 381/152, 166, 300, 394, 396, 397, 398, 381/403, 404, 407, 409, 425, 431, 89, 381/116, 186, 191, 345, 386, 387, 395, 381/400, 406, 412, 413, 417, 432, 433, 381/399, 343, 410, 421, 423; 702/69; 290/55; 336/126; 505/100
See application file for complete search history.

(56) References Cited

U.S. PATENT DOCUMENTS 3,268,672 A * 8/1966 Roesel, Jr. ..... H04R 1/26 381/186
3,937,904 A * 2/1976 Parker ..... H04R 11/00 381/417
4,322,584 A * 3/1982 Shimada ..... H04R 9/046 381/354

(Continued)

FOREIGN PATENT DOCUMENTS

CN 202587358 12/2012
DE 3917477 12/1990

(Continued)

OTHER PUBLICATIONS

European Search Report (dated Jan. 30, 2012), Application No. 11188464.9-2225—Date Filed—Nov. 9, 2011, 6 pages.

(Continued)

*Primary Examiner* — Gerald Gauthier
(74) *Attorney, Agent, or Firm* — Womble Bond Dickinson (US) LLP

(57) ABSTRACT

A voice coil former including a first portion having a planar region and an out-of plane region that extends outside a plane of the planar region, and wherein a length dimension of the first portion is at least two times greater than a width dimension of the first portion. The former further including a second portion extending from the first portion in a direction perpendicular to the plane of the first portion, the second portion being integrally formed with the first portion and dimensioned to support a voice coil thereon.

22 Claims, 9 Drawing Sheets

(56) References Cited

U.S. PATENT DOCUMENTS 4,395,597 A * 7/1983 Suzuki ..... H04R 7/12 181/170
4,531,608 A 7/1985 Heinz
4,550,797 A * 11/1985 Suzuki ..... H04R 7/02 181/167
4,591,667 A 5/1986 Hino et al.
4,752,963 A 6/1988 Yamazaki et al.
4,799,266 A 1/1989 Sakamoto et al.
4,807,295 A * 2/1989 Dombroski ..... H04R 9/025 381/400
4,829,581 A * 5/1989 Nieuwendijk ..... H04R 1/22 381/184
5,371,805 A * 12/1994 Saiki ..... H04R 7/06 381/398
5,664,024 A * 9/1997 Furuta ..... H04R 7/127 381/396
5,701,359 A * 12/1997 Guenther ..... H04R 7/06 181/157
5,717,775 A * 2/1998 Sakamoto ..... H04R 9/046 381/400
5,933,508 A * 8/1999 Fuke ..... H04R 1/30 381/343
5,940,522 A 8/1999 Cahill et al.
6,088,466 A * 7/2000 Proni ..... H04R 9/02 381/397
6,097,829 A * 8/2000 Guenther ..... H04R 7/06 181/169
6,130,955 A * 10/2000 Aigner ..... H04R 9/046 381/400
6,478,109 B1 * 11/2002 Kam ..... H04R 7/045 181/175
6,490,363 B1 12/2002 Liu
6,853,734 B2 2/2005 Sahyoun
6,868,165 B1 * 3/2005 Fabian ..... H04R 9/022 381/397
6,993,146 B2 1/2006 Sato
6,993,147 B2 1/2006 Godehard
7,185,735 B2 3/2007 Sahyoun
7,286,681 B2 10/2007 Gerkinsmeyer
7,505,603 B2 3/2009 Yoo
7,510,047 B2 3/2009 Muto et al.
7,675,202 B1 * 3/2010 Huang ..... H02K 41/0356 310/13
7,822,221 B2 * 10/2010 Watanabe ..... H04R 1/06 381/150
7,835,538 B2 11/2010 Inoue et al.
7,877,856 B2 2/2011 Fukuyama et al.
7,916,890 B2 3/2011 Irby et al.
7,995,788 B2 8/2011 Funahashi et al.
8,009,857 B2 8/2011 Bohlender et al.
8,041,070 B2 * 10/2011 Kamimura ..... H04R 9/10 381/398
8,111,868 B2 2/2012 Kaiya
8,180,092 B2 5/2012 Grell et al.
8,290,199 B2 10/2012 Pircaro
8,295,538 B2 10/2012 Harris et al.
8,311,263 B2 11/2012 Huang
8,325,968 B2 12/2012 Pan et al.
8,374,379 B2 2/2013 Proni
8,426,735 B2 4/2013 Troosters et al.
8,467,557 B2 6/2013 Miller et al.
8,469,741 B2 6/2013 Oster et al.
8,520,886 B2 * 8/2013 Wilk ..... H04R 1/22 381/386
8,548,191 B2 10/2013 Stead
8,630,440 B2 1/2014 Dickie
9,247,348 B2 1/2016 Wilk
9,338,532 B2 5/2016 Yan
9,538,292 B1 * 1/2017 Boyd ..... H04R 9/04
10,097,926 B2 * 10/2018 Pircaro ..... H04R 9/045
2001/0011615 A1 8/2001 Iwasa
2001/0017928 A1 8/2001 Sugiyama et al.
2002/0025059 A1 * 2/2002 Kudo ..... H04R 7/125 381/423
2002/0039430 A1 * 4/2002 Nakaso ..... H04R 7/12 381/396
2002/0101318 A1 * 8/2002 Smith ..... H01F 17/0013 336/126
2002/0128787 A1 * 9/2002 Seng ..... G11B 20/10009 702/69
2003/0021435 A1 * 1/2003 Nakaso ..... H04R 7/127 381/396
2003/0031338 A1 * 2/2003 Suzuki ..... H04R 9/025 381/398
2003/0068063 A1 4/2003 Usuki et al.
2003/0123692 A1 * 7/2003 Ueki ..... H04R 1/44 381/398
2004/0037447 A1 * 2/2004 Kam ..... H04R 7/045 381/431
2005/0147272 A1 7/2005 Hyre et al.
2005/0257999 A1 * 11/2005 Tomiyama ..... H04R 31/003 181/168
2006/0002569 A1 * 1/2006 Dickie ..... H04R 1/403 381/89
2006/0182302 A1 * 8/2006 Onodera ..... H04R 9/043 381/397
2006/0239499 A1 * 10/2006 Stiles ..... H04R 9/025 381/421
2007/0025587 A1 2/2007 Hlibowicki
2007/0071274 A1 3/2007 Andersen et al.
2007/0154057 A1 * 7/2007 Takayama ..... H04R 9/045 381/396
2007/0258615 A1 * 11/2007 Yeom ..... H04R 9/045 381/413
2008/0137901 A1 6/2008 Michno et al.
2008/0205686 A1 * 8/2008 Tagami ..... H04R 9/025 381/398
2008/0279415 A1 11/2008 Roemer et al.
2009/0028371 A1 * 1/2009 Bailey ..... H04R 9/025 381/386
2009/0074228 A1 * 3/2009 Mango, III ..... H04R 31/003 381/432
2009/0116682 A1 * 5/2009 Suzuki ..... H04R 9/00 381/412
2009/0161905 A1 * 6/2009 Konuma ..... H04R 7/127 381/412
2009/0185711 A1 * 7/2009 Shigeta ..... H04R 9/06 381/413
2009/0190792 A1 * 7/2009 Townsend ..... H04R 1/288 381/398
2009/0214075 A1 * 8/2009 Inoue ..... H04R 9/045 381/413
2009/0226018 A1 9/2009 Nielsen et al.
2009/0226028 A1 9/2009 Suganuma
2009/0257617 A1 * 10/2009 Ikeda ..... H04R 9/047 381/410
2009/0279720 A1 * 11/2009 Kim ..... H04R 7/14 381/191
2010/0215207 A1 8/2010 Funahashi
2010/0215209 A1 8/2010 Frasl
2010/0316249 A1 * 12/2010 Kamimura ..... H04R 9/043 381/399
2011/0075880 A1 * 3/2011 Kamimura ..... H04R 1/06 381/413
2011/0123061 A1 * 5/2011 Kamimura ..... H04R 9/025 381/412
2011/0142277 A1 * 6/2011 Bank ..... H04R 1/24 381/396
2011/0150264 A1 * 6/2011 Konuma ..... H04R 9/025 381/398
2011/0150265 A1 * 6/2011 Pan ..... H04R 9/06 381/400
2011/0177952 A1 * 7/2011 Maher ..... H01F 6/06 505/100
2011/0233938 A1 * 9/2011 Stiesdal ..... H02K 1/182 290/55
2011/0274309 A1 11/2011 Doh et al.

(56) References Cited

U.S. PATENT DOCUMENTS

2012/0068707 A1* 3/2012 Begg ..... G01R 33/385 324/318
2012/0121121 A1* 5/2012 Wilk ..... H04R 1/22 381/400
2012/0170778 A1* 7/2012 Wei ..... H04R 9/06 381/191
2012/0170794 A1* 7/2012 Kim ..... H04R 9/043 381/413
2012/0250931 A1* 10/2012 Diedrich ..... H04R 7/12 381/433
2012/0251812 A1 10/2012 Kawka et al.
2012/0263340 A1* 10/2012 Stead ..... H04R 7/20 381/400
2013/0016874 A1* 1/2013 Huang ..... H04R 9/043 381/433
2013/0058519 A1* 3/2013 Wilk ..... H04R 9/025 381/387
2013/0195311 A1 8/2013 Sahyoun
2013/0272563 A1* 10/2013 Boyd ..... H04R 1/00 381/406
2014/0029784 A1* 1/2014 Kwon ..... H04R 7/10 381/395
2014/0140559 A1* 5/2014 Graham ..... H04R 9/06 381/345
2014/0241565 A1 8/2014 Jin
2014/0241566 A1 8/2014 Choi et al.
2014/0270323 A1* 9/2014 Permanian ..... H04R 9/025 381/394
2015/0256939 A1* 9/2015 Zhao ..... H04R 9/06 381/116
2015/0326975 A1* 11/2015 Takada ..... H04R 3/00 381/407
2015/0357078 A1 12/2015 Lessing et al.
2016/0014524 A1* 1/2016 Takada ..... H04R 7/20 381/398
2016/0025669 A1 1/2016 Sun et al.
2016/0057543 A1 2/2016 Salvatti et al.
2016/0219353 A1* 7/2016 Whitwell ..... H03F 3/181
2016/0234618 A1* 8/2016 Honda ..... H04R 1/02
2016/0360313 A1* 12/2016 Mikalauskas ..... H04R 7/045
2017/0026746 A1* 1/2017 Reining ..... H04R 1/2873
2017/0127186 A1* 5/2017 Schoeffmann ..... H04R 7/26
2017/0359647 A1* 12/2017 Oshima ..... H04R 1/24
2018/0115830 A1* 4/2018 Salvatti ..... H04R 9/06
2018/0295449 A1* 10/2018 Morgan ..... H04R 9/025
2018/0367918 A1* 12/2018 Salvatti ..... H04R 9/06
2018/0369866 A1* 12/2018 Sammoura ..... B06B 1/0622

FOREIGN PATENT DOCUMENTS

EP 1799011 A1 6/2007
EP 1845750 A1 10/2007
KR 20110002370 1/2011
KR 20130017552 2/2013
TW I245575 12/2005
WO WO-2011007403 1/2011
WO WO-2011135291 11/2011
WO WO-2013007112 1/2013
WO WO-2014094776 6/2014

OTHER PUBLICATIONS

PCT International Search Report and Written Opinion (dated Mar. 2, 2012), International Application No. PCT/US2011/059808, International Filing Date—Nov. 8, 2011, 12 pages.
Non-Final Office Action (dated Dec. 28, 2012), U.S. Appl. No. 12/985,024, filed Jan. 5, 2011, First Named Inventor: Christopher Raymond Wilk, 13 pages.
CN First Office Action (dated Nov. 22, 2013), Application No. 201110433808.5, Date Filed—Nov. 11, 2011, 19 pages.
ROC (Taiwan) Search Report (dated Mar. 3, 2014), Patent Application No. 100141337, Date Filed—Nov. 11, 2011, 9 pages.
ROC (Taiwan) Office Action (dated Mar. 24, 2014), Patent Application No. 100141337, Date Filed—Nov. 11, 2011, 4 pages.
CN Second Office Action (dated Jul. 10, 2014), Application No. 201110433808.5, Date Filed—Nov. 11, 2011, 6 pages.
Non-Final Office Action (dated Nov. 24, 2014), U.S. Appl. No. 13/974,835, filed Aug. 23, 2013, First Named Inventor: Christopher Raymond Wilk, 13 pages.
EP Examination Report (dated Nov. 14, 2014), Application No. 11188464.9, Date Filed—Nov. 9, 2011, 6 pages.
Final Office Action (dated Jun. 12, 2015), U.S. Appl. No. 13/974,835, filed Aug. 23, 2013, First Named Inventor: Christopher Raymond Wilk, 16 pages.
International Search Report and Written Opinion, dated Nov. 5, 2015, Application No. PCT/US2015/043680.
MCM Audio Select, "10" Aluminum Cone Musical Instrument Speaker", (Sep. 8, 2016).

* cited by examiner

HIGH ASPECT RATIO MOVING COIL TRANSDUCER

FIELD

An embodiment of the invention is directed to a high aspect ratio moving voice coil transducer with improved voice coil stability, more specifically, a high aspect ratio speaker assembly having a single piece high aspect ratio former for improving voice coil stability. Other embodiments are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakerphone loudspeakers and earpiece receivers that can benefit from improved audio performance. The loudspeakers may include a moving coil motor to drive sound output. The moving voice coil motor may include a diaphragm, voice coil positioned around a former and magnet assembly positioned within a frame. In some instances, the moving voice coil motor assembly may have a relatively high aspect ratio of length to width that can lead to an increased risk of stiffness and stability problems such as an increase in the severity of the moving assembly's rocking mode. For example, as the aspect ratio of the diaphragm increases (i.e. the ratio of the long dimension, length, to the short dimension, width, increases), the risk of bowing of the former and/or voice coil and/or rocking or twisting along the length dimension of the assembly may increase. Such out of phase movements can result in undesirable acoustic effects, such as acoustic cancellation or distorted sound pressure output.

SUMMARY

An embodiment of the invention is a transducer assembly having high aspect ratio (length:width>3), for example a long and skinny loudspeaker driver with improved stability of the voice coil geometry (to keep the long edges of the voice coil straight) and high bending stiffness which allows the driver to reach high frequencies before partial vibration (breakup modes) occur. In one embodiment, the assembly includes a single piece former onto which the voice coil is wound, and which has the shape of an inverted, U channel extrusion (with a flattened bottom). The U shaped channel can be made from materials such as aluminum, stainless steel, carbon fiber, or the like. The former may be made by stamping and folding a sheet of the desired material into the desired former shape. In one embodiment, an exemplary thickness of the overall former may be from about 25 to 75 microns. In addition, in some embodiments, the former may include stiffening features such as an out-of-plane region along a top side (e.g. a rib or channel), gussets and/or rounded edges. Each of these stiffening features may be formed from the same sheet of material as former so that additional parts and labor are not required. In addition, in some embodiments, a stiffening plate may also be attached to the top side of the former to increase bending stiffness further. In still further embodiments, recognizing that rocking modes is another significant challenge in high aspect ratio transducers the assembly may include a secondary suspension member along the width (or short) edges.

Representatively, in one embodiment, the invention is directed to, a voice coil former including a first portion having a planar region and an out-of plane region that extends outside a plane of the planar region. In some embodiments, a length dimension of the first portion is at least two times greater than a width dimension of the first portion. The former may further include a second portion extending from the first portion in a direction perpendicular to the plane of the first portion, the second portion may be integrally formed with the first portion and dimensioned to support a voice coil thereon. In some cases, the first portion may be operable to vibrate and output sound in response to an electrical audio signal input to a voice coil positioned around the second portion. In addition, the planar region may be entirely within a same plane and surround the out-of plane region, and the planar region may be solid. In some embodiments, the planar region may include at least one opening formed therethrough. The out-of-plane region may be a groove that runs parallel to the length dimension of the first portion, and the groove may extend from the plane of the first portion in a same direction as the second portion. In some embodiments, the out-of-plane region may be a first groove, the former may further include a second groove, and the first groove and the second groove extend from the plane of the first portion in an opposite direction as the second portion. In addition, the former may include a plurality of out-of-plane regions, and the plurality of out-of-plane regions have a length dimension that is parallel to the width dimension of the first portion. The former may further include a plurality of out-of-plane regions, and the plurality of out-of-plane regions may have a same size and shape. The first portion may include four sides, and the second portion extends from only two of the four sides. The former may further include a gusset between the first portion and the second portion, and the gusset may be dimensioned to geometrically stiffen the former. In addition, in some embodiments, a stiffening plate may be positioned on the first portion.

In other embodiments, the invention is directed to a high aspect ratio voice coil assembly including a former having a sound radiating portion and a sidewall extending perpendicular to a plane of the sound radiating portion for positioning of a voice coil thereon and a stiffening member integrally formed with the former to improve a stability of a high aspect ratio voice coil positioned thereon. In some embodiments, the voice coil may have an aspect ratio of at least 3.0. In some embodiments, an angle formed between the sound radiating portion and the sidewall is ninety degrees or less. The sound radiating portion may include a planar region that is entirely within the plane of the sound radiating portion, and the stiffening member comprises an out-of-plane region that protrudes outside the plane of the planar region and is surrounded by the planar region. The stiffening member may include a hem formed at an end of the sidewall, and the hem may be dimensioned to geometrically stiffen the former. In some cases, the stiffening member may include a plurality of indentations formed within adjoining portions of the sound radiating portion and the sidewall. In some embodiments, the sidewall may include at least one opening that extends through the sidewall. In addition, a material of the sound radiating portion, the sidewall and the stiffening member may be aluminum, titanium, stainless steel or carbon fiber. The high aspect ratio voice coil assembly may further include a frame, a magnet assembly coupled to the frame, wherein the former is suspended from the frame by a suspension member and positioned over the magnet assembly, and the voice coil is positioned around the sidewall of the former.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
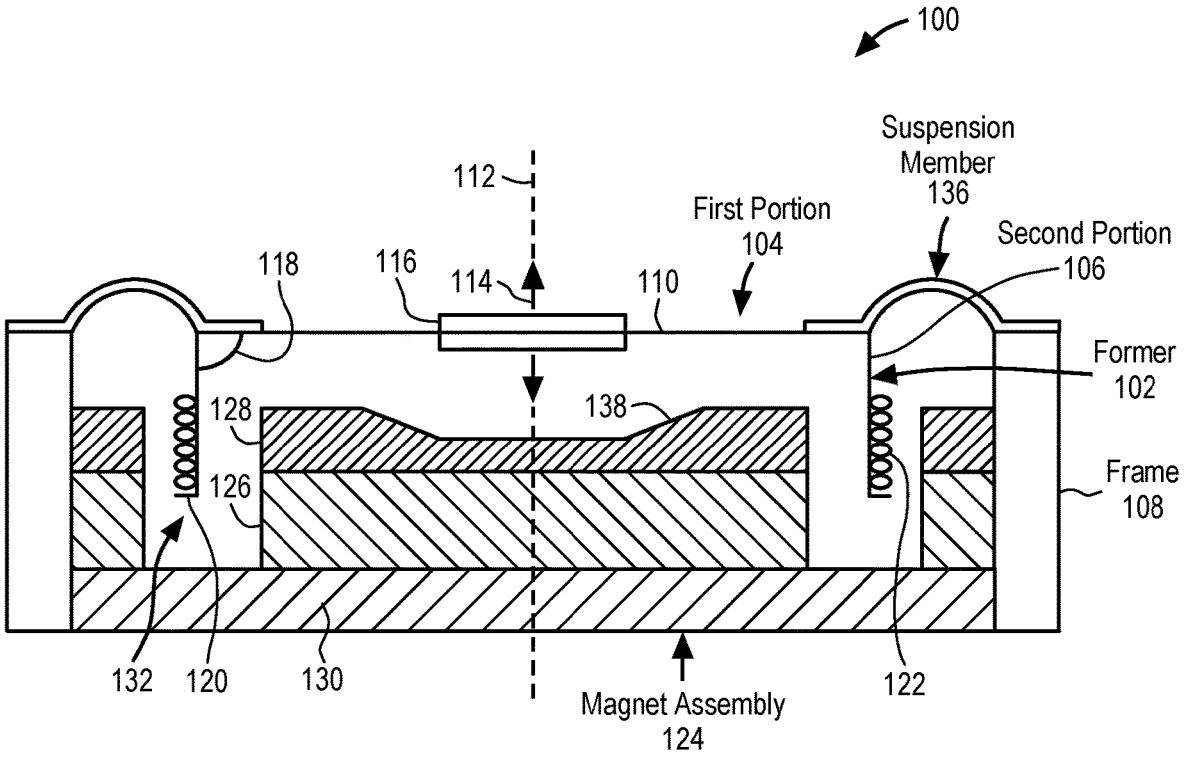
FIG. 1 illustrates a cross-sectional side view of one embodiment of a transducer assembly.

FIG. 1 illustrates a cross-sectional side view of one embodiment of a transducer assembly. Transducer assembly 100 may be any type of transducer that converts a signal in one form of energy to another form. For example, transducer assembly 100 may be an electroacoustic transducer having a sound radiating member or diaphragm and circuitry configured to produce a sound in response to an electrical audio signal input. For example, transducer assembly 100 may be a loudspeaker or micro-speaker that outputs audible sound to a user. In other embodiments, transducer assembly 100 may be a transducer that converts sound into an electrical signal, such as, for example, a microphone. In some embodiments, transducer assembly 100 is considered a high aspect ratio transducer in that transducer (and its associated components) has a length that is greater than its width, for example, a length that is at least two times, or at least three times, greater than its width. For example, transducer assembly 100 may have a high aspect ratio of 2.0, or in some embodiments, a high aspect ratio of 3.0. In this aspect, the various components of transducer assembly 100 may further include any number of stiffening or reinforcement members to improve stability (e.g., prevent bowing of the associated high aspect ratio voice coil) and/or high bending stiffness, which allows the transducer to reach high frequencies before partial vibration (breakup modes) occur.

Representatively, in one embodiment, to improve stability and/or achieve high bending stiffness, transducer assembly 100 may include a single piece former 102 having an inverted, substantially U shaped (with substantially flat top) channel structure. More specifically, former 102 may include a first portion 104 and a second portion 106 that form the channel, and may be suspended from a frame 108, and over magnet assembly 124 within frame 108, by suspension member 136. Former 102 is considered a single piece in that the first portion 104 and the second portion 106 are inseparable portions of a one-piece, integrally formed structure. For example, first portion 104 and second portion 106 may be manufactured from a sheet of material that is, for example, stamped or pressed, to form portions of the sheet into the shape of first portion 104 and second portion 106.

First portion 104 may, in some embodiments, be a horizontally extending member that can vibrate and produce sound in response to an electrical audio signal input. For example, first portion 104 may be a sound radiating portion or speaker diaphragm, as this term is commonly used in the context of speakers. In other embodiments, where transducer assembly 100 is, for example, a microphone, first portion 104 may be a sound pick-up surface that vibrates in response to a sound input and produces an electrical audio signal output. In this aspect, first portion 104 may include a substantially flat or planar region 110 that can vibrate or otherwise move in an axial direction 114 (along axis 112) to generate a sound output, or receive a sound input. Planar region 110 may, in some embodiments, be entirely within a single plane, as will be described in more detail in reference to FIG. 2.

In addition, to, for example, improve stability, first portion 104 may further include an out-of-plane region 116, which protrudes outside the plane of planar region 110. For example, out-of-plane region 116 may extend above or below the plane or planar region 110. The out-of-plane region 116 may be dimensioned to geometrically stiffen portions of the former 102 (e.g., first portion 104 or second portion 106) and/or a voice coil 122 wrapped around former 102. The out-of-plane region 116 may be formed by a single out-of-plane structure, or a number of out-of-plane structures formed within first portion 104. The specific dimensions and configuration of out-of-plane region 116 will be described in more detail in reference to FIGS. 2-7.

Second portion 106 may extend from first portion 104 in a direction outside the plane of first portion 104 and support a voice coil 122. For example, second portion 106 may be, or otherwise include, a wall or surface that extends from first portion 104 in a direction parallel to axis 112. In this aspect, in some embodiments, an interior angle 118 formed between the interior surfaces of first portion 104 (or the plane of first portion) and second portion 106 may be ninety degrees or less. Second portion 106 may be considered as being below first portion 104 and, in some embodiments, confined to an area that is within a footprint of first portion 104. In addition, although not shown, voice coil 122, which is wrapped around second portion 106, may have electrical connections to a pair of terminals through which an audio signal is received (or output), in response to which voice coil 122 produces a changing magnetic field that interacts with the magnetic field produced by magnet assembly 124 for driving transducer assembly 100. In addition, it should be understood that because second portion 106 is integrally formed with first portion 104, it eliminates the need to glue two separate pieces together (e.g., a bobbin to a diaphragm). This, in turn, provides the advantage of a more efficient way to couple the coil force to the air and leads to a smoother acoustic output to a higher frequency. In some embodiments, second portion 106 may further include stiffening or reinforcement members to improve a stability of transducer assembly 100, for example, to prevent bowing of the associated high aspect ratio voice coil 122. Representatively, second portion 106 may include a hem 120 formed by the end of second portion 106 opposite first portion 104. The specific dimensions and configuration of the hem 120 will be described in more detail in reference to FIGS. 2-7.

In addition, it should be understood that in some embodiments where former 102 is made of a thermally conductive material, it may also serve as a heat sink for the voice coil 122. For example, former 102 may be stamped from a single piece of a thermally conductive material such as aluminum. The aluminum within second portion 106 will, in turn, transfer the heat generated by the surrounding voice coil 122 to first portion 104, where it is then dissipated away from first portion 104 as first portion 104 vibrates. It should be understood, however, that aluminum is just one exemplary material that could be used to form former 102, and that other materials such as titanium, stainless steel, an aluminum alloy or a magnesium alloy, carbon fiber, or the like, are also contemplated. In addition, in some embodiments, former 102 may be formed from a sheet of material with an overall thickness of 100 microns or less, for example, from about 10 microns to about 50 microns, or 30 microns.

The entire former 102 may be suspended within frame 108 by suspension member 136. Suspension member 136 may be a compliant member that allows for the substantially vertical movement of former 102 (e.g., along arrows 114). Suspension member 136 may, in one embodiment, have one side that is directly attached to an exterior surface, or top side, of planar region 110 and another side that is attached to frame 108. Suspension member 136 may be attached to an entire perimeter area of planar region 110, or only a portion of planar region 110 (e.g., only the long dimension or only the short dimension). Suspension member 136 may be formed by any suitably compliant material capable of suspending former 102 (e.g. polyether ether ketone (PEEK)).

Transducer assembly 100 may further include a magnet assembly 124 mounted to frame 108. In this embodiment, magnet assembly 124 includes a permanent magnet 126 sandwiched by a ferromagnetic top plate 128 and a bottom plate 130. Magnet assembly 124 further includes an air gap 132 through which a magnetic flux is directed. The former 102 with voice coil 122 attached thereto is in turn positioned within air gap 132. In addition, in some embodiments, top plate 128 may optionally include a recessed region 138. Recessed region 138 may be aligned with out-of-plane region 116 and provide more space between first portion 104 and magnet assembly 124 for vibration of first portion 104. For example, in some embodiments, recessed region 138 may have a similar profile to that of out-of-plane region 116 (e.g., curved or concave shape). Still further, it is contemplated that in some embodiments, an optional opening may be formed through the portion of magnet assembly 124 below first portion 104. The opening may further accommodate excursion of first portion 104 (e.g., allow first portion 104 to move up and down without contacting the surface), while also serving as a means for acoustic venting.

Figure 2:
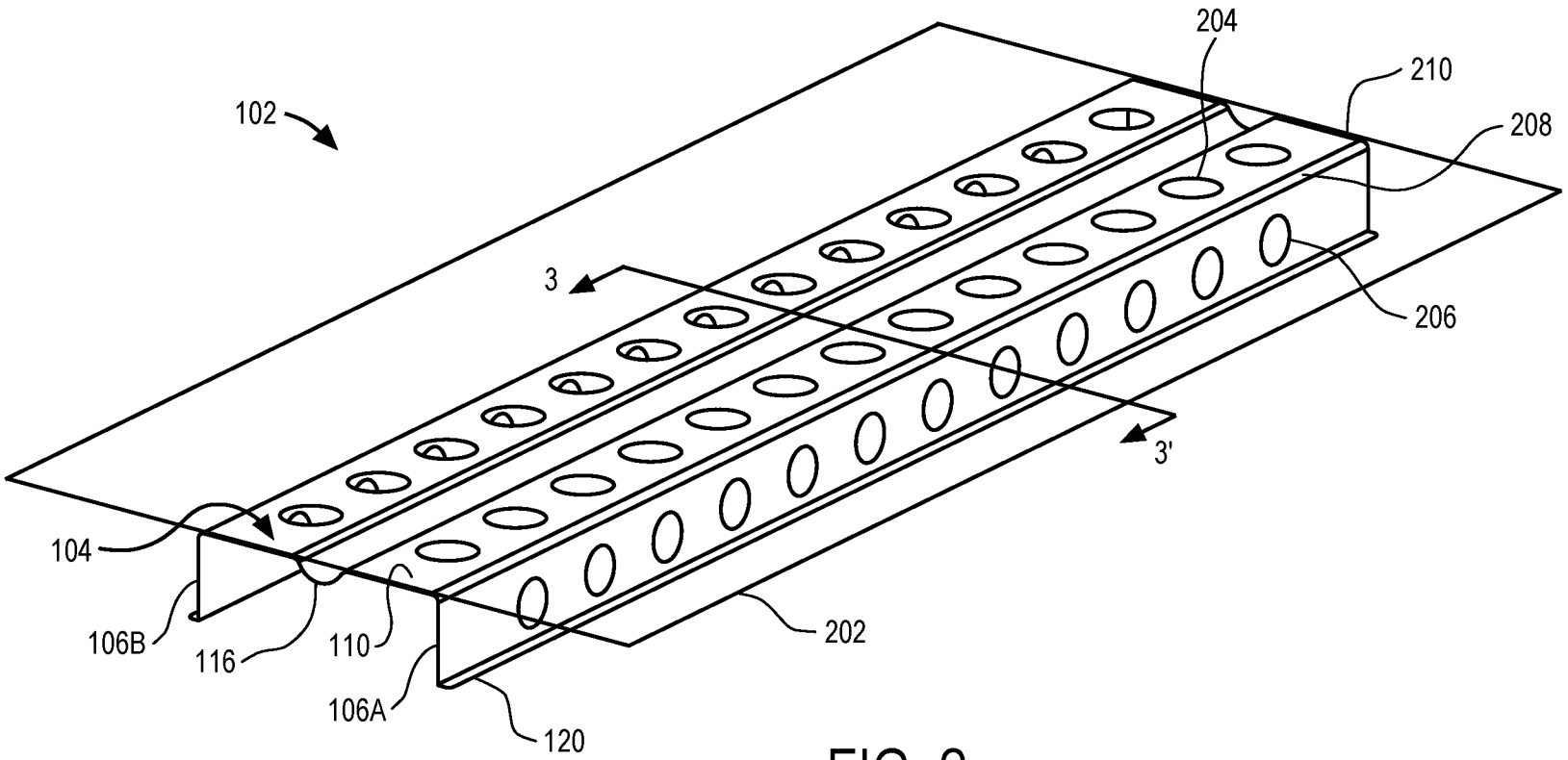
FIG. 2 illustrates a perspective view of one embodiment of a voice coil former used in the transducer assembly of FIG. 1.

FIG. 2 illustrates a perspective view of one embodiment of a voice coil former used in the transducer assembly of FIG. 1. From this view, it can be seen that in one embodiment, former 102 has a substantially high aspect ratio, for example, an overall length that is at least two times, or at least three times that of its width. In addition, planar region 110 of first portion 104 may be entirely within a same plane 202, while out-of-plane region 116 extends outside of plane 202 (and from planar region 110), for example, below plane 202. It is contemplated, however, that while in this embodiment, out-of-plane region 116 is shown extending below plane 202 (or in a same direction as second portion 106), in other embodiments, out-of-plane region 116 may extend above plane 202 (or in a direction opposite second portion 106). In addition, planar region 110 may surround, form, or occupy, the entire region between out-of-plane region 116 and second portion 106, such that the area between out-of-plane region 116 and second portion 106 is planar or flat. Moreover, from this view, it can be seen that out-of-plane region 116 extends along the entire length of former 102. Representatively, out-of-plane region 116 may be a longitudinal groove or channel which is stamped from a material of former 102 such that a recessed region is formed in the top side of first portion 104 and it is one integrally formed, and continuous piece, with planar region 110. In some embodiments, out-of-plane region 116 may be more of a solid protruding member such as a rib-like structure that extends below (or above) plane 202, but does not have a corresponding recessed (or hollow) region along the opposite side. Other shapes, sizes and/or configurations, however, are also contemplated.

Second portion 106 may include two separate arms or sidewalls 106A, 106B that are parallel to each other and extend outside of plane 202. For example, second portion 106 may include sidewalls 106A, 106B that extend from first portion 104 (or plane 202) in a downward or vertical direction, that is parallel to axis 112 (shown in FIG. 1). In other words, sidewalls 106A, 106B extend in a same direction as out-of-plane region 116. In some embodiments, first portion 104 may be considered as having four sides, for example, two length sides 208 and two width sides 210, and sidewalls 106A, 106B may extend along only the length sides 208 of former 102. In this aspect, the width sides 210 (or ends) of former 102, and the inverted U shaped (with substantially flat top) channel formed by former 102, are considered open. Sidewalls 106A, 106B may be integrally formed with first portion 104 (as by bending the edges of a single sheet of material) such that former 102 is one continuous, unibody structure.

Former 102 may further include openings 204, 206 formed through first portion 104 and second portion 106. Openings 204, 206 may have any size, shape and pattern (e.g., round, elongated, square, or the like) suitable for reducing a mass of former 102. In some embodiments, openings 204, 206 may be dimensioned or positioned to allow for ventilation of heat, or adjustment of the acoustic resistance. For example, a hole pattern could be selected with relatively fewer large-size holes for the purpose of mass reduction, or alternatively or in combination, a higher number of smaller-sized holes may be positioned to provide a tailored amount of acoustic resistance via viscous loss of airflow pumping through small orifices. Openings 204, 206 may be formed entirely through one, or both, of the walls forming first portion 104 and second portion 106. It is further contemplated that while a number of openings 204, 206 are shown, in some embodiments, only one of openings 204 and/or 206 may be presented. In addition, in embodiments, where openings 204 are formed through first portion 104 as shown, a separate stiffening member, or other solid plate-like structure, may be placed over first portion 104 to cover the openings 204 so that first portion 104 may be used as a sound pick-up or sound radiating surface. An embodiment including a stiffening member will be discussed in more detail in reference to FIG. 8.

Figure 3:
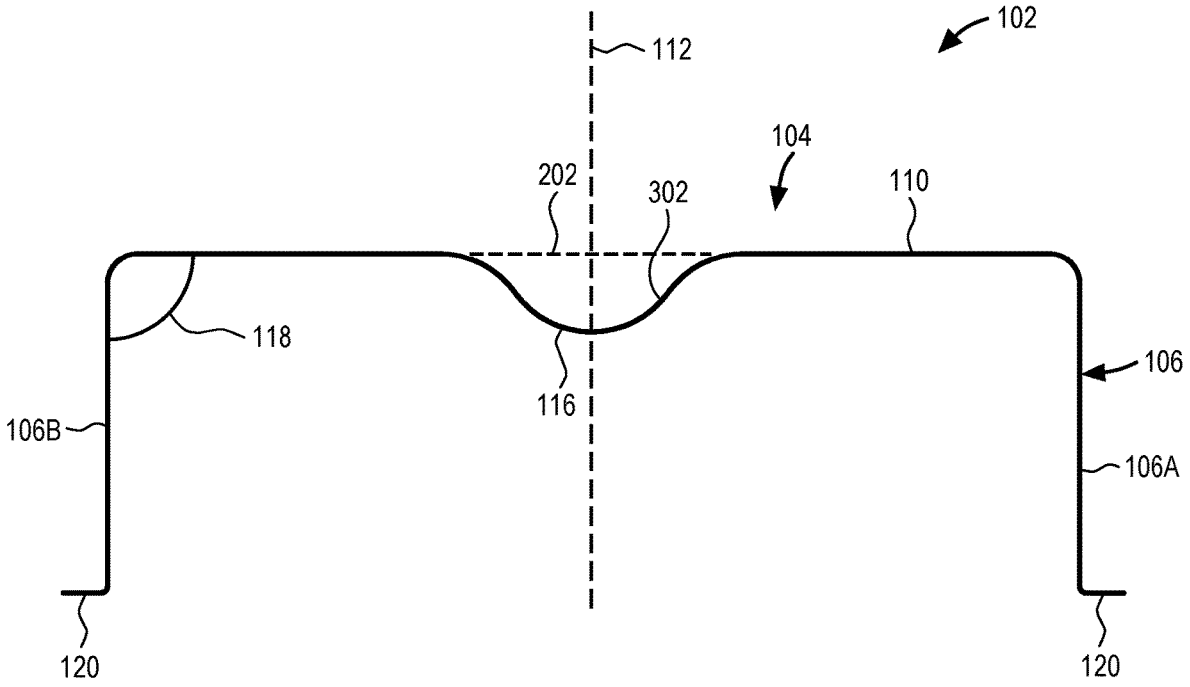
FIG. 3 illustrates a cross-sectional side view of the voice coil former of FIG. 2 along line 3-3'.

FIG. 3 illustrates a cross-sectional side view of the voice coil former of FIG. 2 along line 3-3'. From this view, it can be seen that sidewalls 106A, 106B of second portion 106 are vertically oriented (e.g., parallel to axis 112) with respect to first portion 104 such that they form an outer surface that may be considered perpendicular to the planar region 110 of first portion 104. In this aspect, angle 118 formed between sidewalls 106A, 106B can be understood to be 90 degrees. It is contemplated, however, that in some embodiments, sidewalls 106A, 106B of second portion 106 and/or planar region 110 of first portion 104 may be oriented such that angle 118 is less than 90 degrees.

In addition, sidewalls 106A, 106B may include hem 120. Hem 120 may be of any size and shape sufficient to support a voice coil and/or provide further stiffness and/or stability to former 102. Representatively, hem 120 may be a substantially flat structure that extends along the entire length of sidewalls 106A, 106B, in a substantially horizontal or lateral direction (e.g., perpendicular to axis 112). The hem may run only partially around the perimeter, forming discrete tabs providing coil support and some measure of extra stiffness. In this aspect, hem 120 may be considered to form a 90 degree angle with sidewalls 106A, 106B. In other embodiments, however, hem 120 may have other configurations. For example, hem 120 may curved, or otherwise bent, in an upward direction such that it is substantially parallel to sidewalls 106A, 106B. In this aspect, hem 120 may be flattened against the outer surface of sidewalls 106A, 106B, or a gap may be formed between the outer surface of sidewalls 106A, 106B and hem 120. In other embodiments, hem 120 may form a tear drop like shape, or an inverted question mark like shape along the bottom of sidewalls 106A, 106B. Regardless of the particular geometry of hem 120, it can be formed form a same material as the former sidewalls 106A, 106B, for example, by bending the bottom ends or portions of sidewalls 106A, 106B into the desired geometry. In addition, hem 120 may be shorter than sidewalls 106A, 106B such that it does not extend along an entire height of sidewalls 106A, 106B when it is in the vertical, teardrop or question mark shape, such that it does not cover the entire outer surface of sidewalls 106A, 106B.

Referring now to out-of-plane region 116 in more detail, from this view, it can be seen that out-of-plane region 116 has a relatively narrow, curved shape, which is confined to a middle region of first portion 104. In other words, it does not extend the entire width of first portion 104 such that the entire first portion 104 is curved. Rather, the area around out-of-plane region 116, or between out-of-plane region 116 and second portion 106, is the planar region 110, which is entirely flat and within plane 202. In other embodiments, out-of-plane region 116 may have other shapes (e.g. v shaped, flat bottom, etc.). In addition, in some embodiments, the out-of-plane region 116 may be stamped from the same material as the rest of first portion 104 such that a recessed region 302 is formed along the top side of first portion 104. In other words, the top side of first portion 104 is also outside (e.g., below) plane 202, and may be considered open or hollow. In this aspect, the out-of-plane region 116 may be referred to as forming a channel or groove along first portion 104. In some cases, the out-of-plane region 116 may be a relatively solid member, for example a rib, which extends below plane 202 along one side but does not form a recessed region 302, but rather the entire top side of first portion 104 remains solid or flat, and within plane 202. For example, in this embodiment, out-of-plane region 116 may be formed by a thickened region of the material used to form first portion 104.

Figure 4:
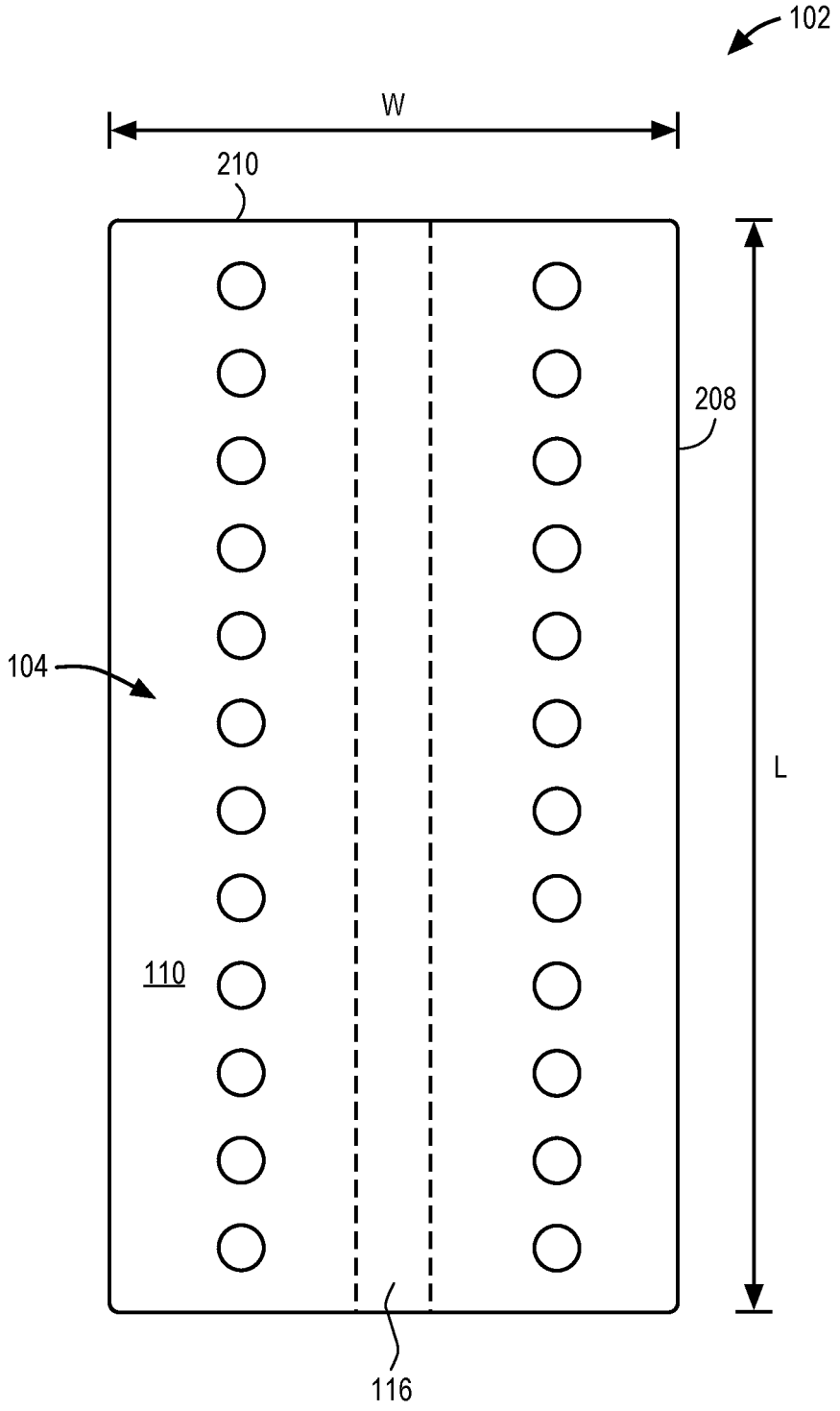
FIG. 4 illustrates a top plan view the voice coil former of FIG. 2.

The specific dimensions of first portion 104 of former 102 will now be discussed in more detail in reference to FIG. 4. Representatively, FIG. 4 illustrates a top plan view of former 102 of FIG. 2. From this view, it can be seen that first portion 104 includes a length dimension (L) that is greater than its width dimension (W). For example, in this embodiment, first portion 104 may have a substantially rectangular shape with two length sides 208 and two width sides 210. First portion 104 (and in turn former 102) may be considered to have a high aspect ratio in that the length sides 208 may be two times, three times, or more, greater than the width sides 210. In other embodiments, first portion 104 may have other shapes having a length dimension (L) that is at least two or three times greater than the width dimension (W), in other words having a high aspect ratio. For example, first portion 104 may have an elliptical or racetrack like shape, in which the length dimension is significantly greater than the width dimension. It can further be seen from this view that out-of-plane region 116 is a longitudinally extending member that is parallel to the length dimension (L), and extends the entire length. In addition, planar region 110 occupies the entire area between out-of-plane region 116 and the length sides 208 of first portion 104. In other words, the entire area of former 102 surrounding out-of-plane region 116 is planar or flat.

Figure 5:
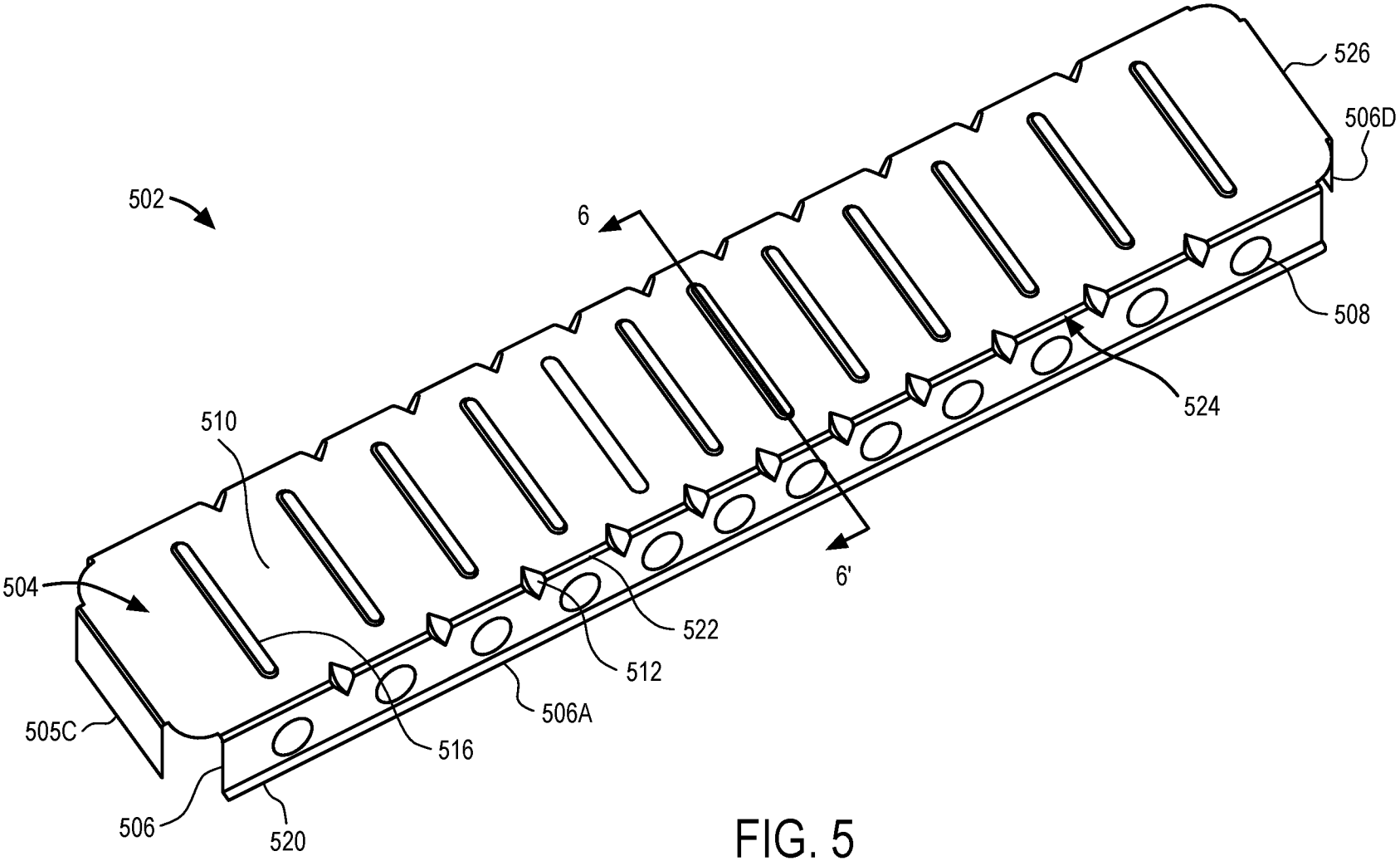
FIG. 5 illustrates a perspective view of another embodiment of a voice coil former implemented in the transducer assembly of FIG. 1.

FIG. 5 illustrates a perspective view of another embodiment of a voice coil former implemented in the transducer assembly of FIG. 1. Former 502 is a high aspect ratio former similar to former 102, except that in this embodiment, former 502 includes a number of out-of-plane regions 516 for added stiffness, and additional stiffening or reinforcement members 512. In particular, similar to former 102, former 502 includes a horizontal first portion 504 and a vertical second portion 506, that extends from, and is integrally formed with, first portion 504, as previously discussed. Second portion 506 may further include a hem 520 including any of the previously discussed configurations. Former 502, however, further includes a number of out-of-plane regions 516 formed between the planar region 510 of first portion 104. In addition, in this embodiment, out-of-plane regions 516 are elongated structures that, instead of extending parallel to the length dimension of the former, extend parallel to the width dimension of former 502. In other embodiments, out-of-plane regions 516 may have any size and shape sufficient to provide additional stiffness and/or stability to former 502. For example, out-of-plane regions 516 may have a concave, cone, pyramid, square or the like profile and/or shape. The specific dimensions of out-of-plane regions 516 will be described in more detail in reference to FIG. 6 and FIG. 7.

In addition, a number of stiffening or reinforcement members 512 may be formed within the adjoining regions between first portion 504 and second portion 506, referred to as corners or edges 522. Representatively, reinforcement members 512 may be formed within the corners or edges 522 of former 502, between each of out-of-plane regions 516. Reinforcement members 512 may be indentations, gussets or the like which are integrally formed within the portions of first portion 504 and second portion 506 then adjoin to form the edges 522 of former 502. For example, in some embodiments, reinforcement members 512 may be triangular, cone or pyramid like, shaped regions that are stamped into corners or edges 522 and protrude into the interior region of former 502. In some embodiments, reinforcement members 512 may be formed as one continuous piece within the corners or edges 522 of former 502 such that no openings are formed through the corners or edges 522 of former 502, while in other embodiments there may be openings formed around, or within, reinforcement members 512. Reinforcement members 512 may be formed, for example, by stamping indentations into the corner regions of former 502 as shown, such that they are integrally formed parts of former 502. In other embodiments, reinforcement members 512 could be solid members, or be separate pieces, which are attached to corners or edges 522. In addition, while reinforcement members 512 are shown formed between each of out-of-plane region 516, any number of reinforcement member 512, and in any configuration, suitable to stiffen former 502, may be used.

Still further, in this embodiment, second portion 506 may extend from all four sides of first portion 504. Representatively, second portion 506 may include sidewalls 506A, 506B (see sidewall 506B shown in FIG. 7) which extend from the length sides 524 of first portion 504 and sidewalls 506C, 506D extending from the width sides 526 of first portion 504. In some embodiments, sidewalls 506A, 506B and sidewalls 506C, 506D are not connected at their ends such that gaps are formed between each of the sidewalls as shown. In other words, sidewalls 506A-506D do not extend from an entire perimeter of first portion 504. In other embodiments, sidewalls 506A-506D may form one continuous sidewall along an entire perimeter of first portion 504. Openings 508 may further be formed in one or more of sidewalls 506A-506D and/or first portion 504. For example, in the illustrated embodiment, openings 508 are only formed in sidewalls 506A and 506B, and first portion 504 is solid.

Figure 6:
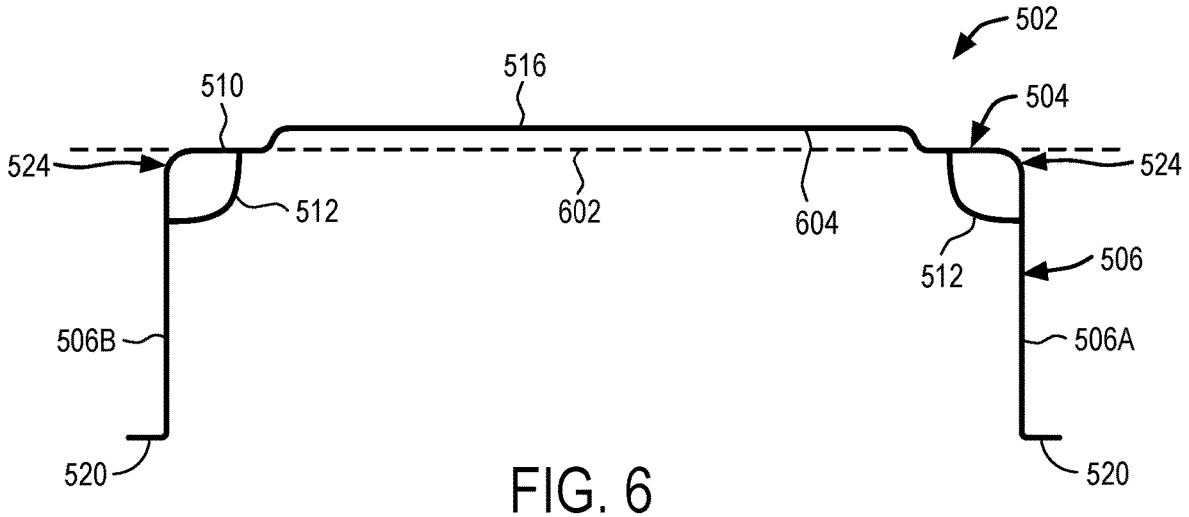
FIG. 6 illustrates a cross-sectional side view of the voice coil former of FIG. 5 along line 6-6'.

Referring in more detail now to out-of-plane regions 516, FIG. 6 illustrates a cross-sectional side view of the voice coil former of FIG. 5 along line 6-6', which is through one of the out-of-plane regions 516. From this view, it can be seen that in this embodiment, out-of-plane regions 516 extend above a plane 602 of the planar region 510 of first portion 504. In other words, out-of-plane regions 516 extend from plane 602 in a direction opposite that of second portion 506. It is contemplated, however, that in other embodiments, out-of-plane regions 516 may extend below plane 602, or some may extend above and some may extend below plane 602. In addition, a corresponding recessed region 604 is formed along the outer surface of first portion 504, such that the outer surface of first portion 504 also extends below the plane 602 of planar region 510. In other words, out-of-plane region 516 is a groove or channel shaped structure that is, for example, stamped out of the material used to form first portion 504. In other embodiments, out-of-plane region 516 may be more of a rib shaped structure that is substantially solid and does not include the corresponding recessed region 604. Out-of-plane region 516 may have any cross-sectional shape suitable for adding stiffness to former 502. For example, in this embodiment, out-of-plane region 516 is shown having a substantially flat top surface, which is parallel to plane 602. Other shapes and sizes, however, are possible.

In addition, reinforcement members 512 are shown formed within corners or edges 522, which are formed by adjoining portions of first portion 504 and second portion 506, along both sides of former 502. Reinforcement members 512 may further protrude into the interior area of former 502. It is contemplated, however, that in other embodiments, reinforcement members 512 may be outwardly protruding members, or may be separate structures attached to the corners 522.

Figure 7:
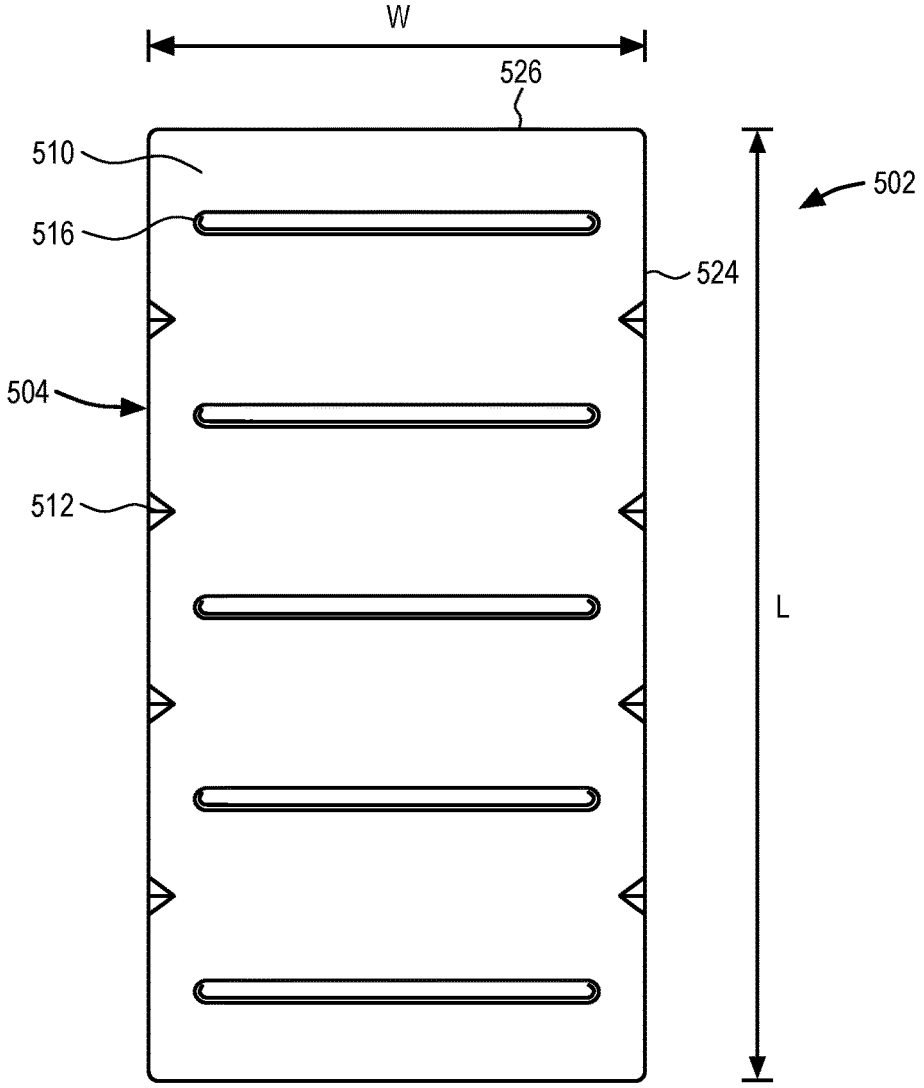
FIG. 7 illustrates a top plan view the voice coil former of FIG. 5.

FIG. 7 illustrates a top plan view the voice coil former of FIG. 5. From this view, it can be seen that first portion 504 includes a length dimension (L) that is greater than its width dimension (W). For example, in this embodiment, first portion 504 may have a substantially rectangular shape with two length sides 524 and two width sides 526. First portion 504 (and in turn former 502) may be considered to have a high aspect ratio in that the length sides 524 may be two times, three times, or more, greater than the width sides 526. In other embodiments, first portion 504 may have other shapes having a length dimension (L) that is at least two or three times greater than the width dimension (W), in other words having a high aspect ratio. For example, first portion 504 may have an elliptical or racetrack like shape, in which the length dimension is significantly greater than the width dimension. It can further be seen from this view that out-of-plane region 516 includes a number of laterally extending structures that are parallel to the width dimension (W), and are spaced from one another along the length dimension (L) of first portion 504. In addition, the entire area between each of out-of-plane regions 516 is made up of planar region 510. In other words, planar region 510 entirely surrounds out-of-plane regions 516. Although five out-of-plane regions 516 are shown, it is contemplated, that any number of out-of-plane regions suitable for stiffening former 502 may be used, with spacing between each region.

Figure 8:
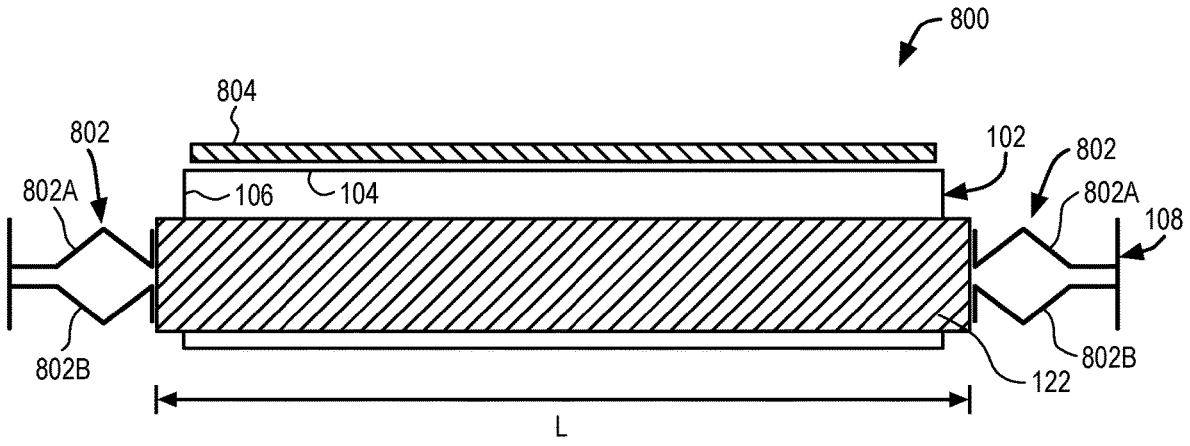
FIG. 8 illustrates a side view of one embodiment of a voice coil former assembly used in the transducer assembly of FIG. 1.

FIG. 8 illustrates a side view of one embodiment of a voice coil former assembly used in the transducer assembly of FIG. 1. Representatively, voice coil former assembly 800 may include former 102, which includes first portion 104 and second portion 106, and voice coil 122 wrapped around second portion 106, as previously discussed in reference to FIG. 1 to FIG. 4. In addition, in this embodiment, voice coil former assembly 800 may further include stiffening member 804. Representatively, stiffening member 804 may be a membrane or plate like structure which is positioned along a top surface of first portion 104 to provide further stiffness and facilitate sound radiation or sound pick-up by first portion 104. For example, when first portion 104 includes openings, it may not be able to operate as a sound pick-up or sound radiating surface (e.g., a speaker diaphragm). It is therefore necessary to provide a substantially solid stiffening member 804 over first portion 104 to plug the openings and provide further stiffness to first portion 104. Stiffening member 804 may be made of a same material as first portion 104, or a different material (e.g., polyether ether ketone). Stiffening member 804 may be attached to first portion 104 by any suitable technique (e.g., chemical or mechanical bonding).

In addition, voice coil former assembly 800 is shown including a secondary suspension member 802 to provide additional stability. In particular, since former 102 has a high aspect ratio as previously discussed, it may be prone to "rocking" (tipping or rotating motion) along the length dimension (L), (W) dimension, or an intermediate angle and, in turn, move in a fashion which does not contribute to the useful acoustic output and increases the risk of undesirable contact between the moving and stationary components. This detrimental behavior can limit the usable maximum excursion of the transducer. Secondary suspension member 802 may therefore be positioned along each of the width ends of former 102 and attached to the frame 108 to provide further stability along these ends and prevent (or reduce) rocking. For example, there may be two separate secondary suspension members 802 positioned along each end of former 102. Secondary suspension member 802 may be within a different plane than suspension member 136 (see FIG. 1), for example, a plane of voice coil 122, which is below suspension member 136. In some embodiments, secondary suspension member 802 may include a top suspension member 802A and a bottom suspension member 802B. Each of top and bottom suspension members 802A, 802B may bow out in opposite directions with respect to one another, and may expand/contract toward and/or away from each other depending upon a motion of voice coil former assembly 800 (e.g., similar to a 4-bar linkage). In one embodiment, secondary suspension member 802 is attached directly to voice coil 122 by any suitable technique (e.g. chemical or mechanical bonding). In other embodiments, member 802 may be attached to another portion of voice coil former assembly 800, for example, a portion of former 102. Secondary suspension member 802 may be made of a same or different material as suspension member 136.

Figure 9:
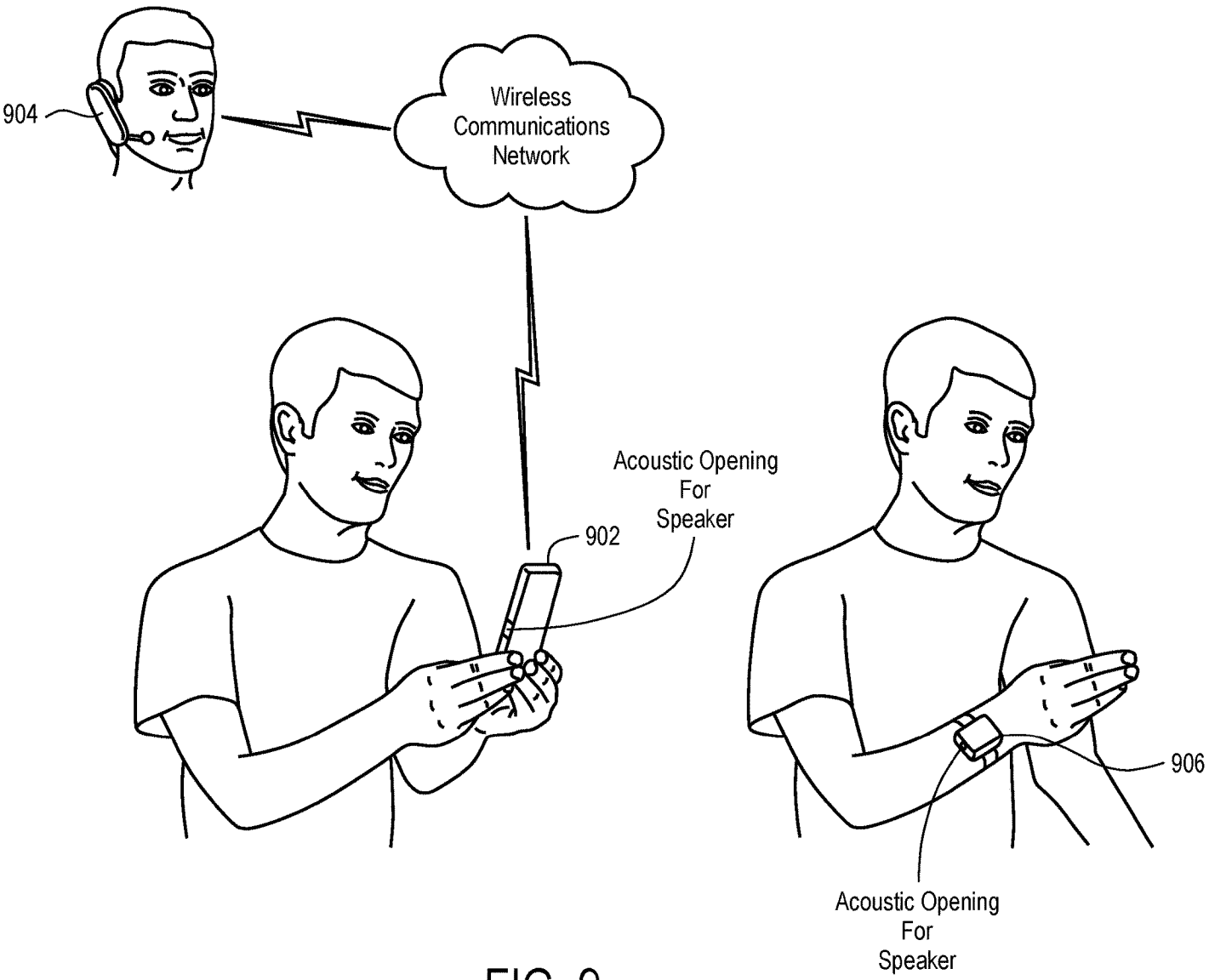
FIG. 9 illustrates one embodiment of a simplified schematic view of embodiments of electronic devices in which the transducer assembly of FIG. 1 may be implemented.

FIG. 9 illustrates one embodiment of a simplified schematic view of embodiments of electronic devices in which a speaker assembly, such as that described herein, may be implemented. As seen in FIG. 9, the speaker may be integrated within a consumer electronic device 902 such as a smart phone with which a user can conduct a call with a far-end user of a communications device 904 over a wireless communications network; in another example, the speaker may be integrated within the housing of a portable timepiece 906. These are just two examples of where the transducer described herein may be used, it is contemplated, however, that the speaker may be used with any type of electronic device in which a speaker is desired, for example, a tablet computer, a computing device or other display device.

Figure 10:
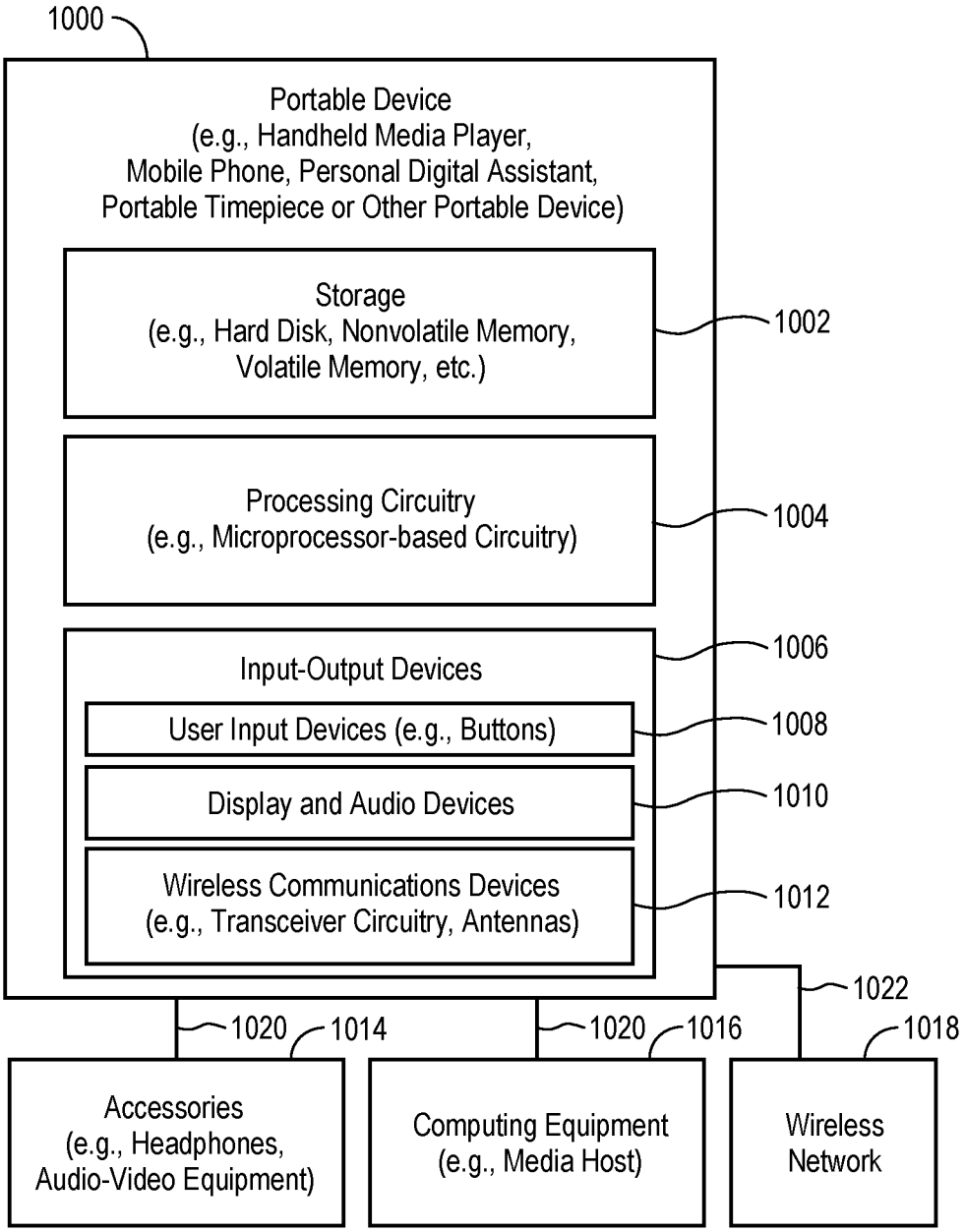
FIG. 10 illustrates a block diagram of one embodiment of an electronic device within which the transducer assembly of FIG. 1 may be implemented.

FIG. 10 illustrates a block diagram of one embodiment of an electronic device within which the previously discussed speaker may be implemented. As shown in FIG. 10, device 1000 may include storage 1002. Storage 1002 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 1004 may be used to control the operation of device 1000. Processing circuitry 1004 may be based on a processor such as a microprocessor and other suitable integrated circuits. With one suitable arrangement, processing circuitry 1004 and storage 1002 are used to run software on device 1000, such as internet browsing applications, voice-over-internet-protocol (VOIP) telephone call applications, email applications, media playback applications, operating system functions, etc. Processing circuitry 1004 and storage 1002 may be used in implementing suitable communications protocols. Communications protocols that may be implemented using processing circuitry 1004 and storage 1002 include internet protocols, wireless local area network protocols (e.g., IEEE 802.11 protocols—sometimes referred to as Wi-Fi®), protocols for other short-range wireless communications links such as the Bluetooth® protocol, protocols for handling 3G or 4G communications services (e.g., using wide band code division multiple access techniques), 2G cellular telephone communications protocols, etc.

To minimize power consumption, processing circuitry 1004 may include power management circuitry to implement power management functions. For example, processing circuitry 1004 may be used to adjust the gain settings of amplifiers (e.g., radio-frequency power amplifier circuitry) on device 1000. Processing circuitry 1004 may also be used to adjust the power supply voltages that are provided to portions of the circuitry on device 1000. For example, higher direct-current (DC) power supply voltages may be supplied to active circuits and lower DC power supply voltages may be supplied to circuits that are less active or that are inactive. If desired, processing circuitry 1004 may be used to implement a control scheme in which the power amplifier circuitry is adjusted to accommodate transmission power level requests received from a wireless network.

Input-output devices 1006 may be used to allow data to be supplied to device 1000 and to allow data to be provided from device 1000 to external devices. Display screens, microphone acoustic ports, speaker acoustic ports, and docking ports are examples of input-output devices 1006. For example, input-output devices 1006 can include user input-output devices 1008 such as buttons, touch screens, joysticks, click wheels, scrolling wheels, touch pads, key pads, keyboards, microphones, cameras, etc. A user can control the operation of device 1000 by supplying commands through user input-output devices 1008. Display and audio devices 1010 may include liquid-crystal display (LCD) screens or other screens, light-emitting diodes (LEDs), and other components that present visual information and status data. Display and audio devices 1010 may also include audio equipment such as speakers and other devices for creating sound. Display and audio devices 1010 may contain audio-video interface equipment such as jacks and other connectors for external headphones and monitors.

Wireless communications devices 1012 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications). Representatively, in the case of a speaker acoustic port as shown in FIG. 9, the speaker may be associated with the port and be in communication with an RF antenna for transmission of signals from the far end user to the speaker.

Returning to FIG. 10, device 1000 can communicate with external devices such as accessories 1014, computing equipment 1016, and wireless network 1018 as shown by paths 1020 and 1022. Paths 1020 may include wired and wireless paths. Path 1022 may be a wireless path. Accessories 1014 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 1016 may be any suitable computer. With one suitable arrangement, computing equipment 1016 is a computer that has an associated wireless access point (router) or an internal or external wireless card that establishes a wireless connection with device 1000. The computer may be a server (e.g., an internet server), a local area network computer with or without internet access, a user's own personal computer, a peer device (e.g., another portable electronic device), or any other suitable computing equipment.

Wireless network 1018 may include any suitable network equipment, such as cellular telephone base stations, cellular towers, wireless data networks, computers associated with wireless networks, etc. For example, wireless network 1018 may include network management equipment that monitors the wireless signal strength of the wireless handsets (cellular telephones, handheld computing devices, etc.) that are in communication with network 1018.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although a speaker is specifically disclosed herein, the unibody former and voice coil assembly disclosed herein could be used with other types of transducers, for example, microphones or other transducers (e.g., ambient pressure sensor). Still further, although a portable electronic device such as a mobile communications device is described herein, any of the previously discussed transducer configurations may be implemented within a tablet computer, personal computer, laptop computer, notebook computer and the like. The description is thus to be regarded as illustrative instead of limiting.

What is claimed is:

1. A voice coil assembly comprising:

a voice coil former having a first portion and a second portion, the first portion having a planar region surrounding an out-of plane region that extends outside a plane of the planar region, and wherein a length dimension of the first portion is at least two times greater than a width dimension of the first portion; and the second portion extending from the first portion in a direction perpendicular to the plane of the first portion, the second portion being integrally formed with the planar region of the first portion surrounding the out-of-plane region and dimensioned to support a voice coil thereon.

2. The voice coil assembly of claim 1 wherein the first portion is operable to vibrate and output sound in response to an electrical audio signal input to a voice coil positioned around the second portion.

3. The voice coil assembly of claim 1 wherein the planar region is entirely within a same plane and completely surrounds the out-of plane region, and the planar region is solid.

4. The voice coil assembly of claim 1 wherein the planar region comprises at least one opening formed therethrough.

5. The voice coil assembly of claim 1 wherein the out-of-plane region is a groove that runs parallel to the length dimension of the first portion, and wherein the groove extends from the plane of the first portion in a same direction as the second portion.

6. The voice coil assembly of claim 1 wherein the out-of-plane region is a first groove, the voice coil former further comprising a second groove, and wherein the first groove and the second groove extend from the plane of the first portion in an opposite direction as the second portion.

7. The voice coil assembly of claim 1 wherein the voice coil former comprises a plurality of out-of-plane regions, and the plurality of out-of-plane regions have a length dimension that is parallel to the width dimension of the first portion.

8. The voice coil assembly of claim 1 wherein the voice coil former comprises a plurality of out-of-plane regions, and the plurality of out-of-plane regions comprise a same size and shape.

9. The voice coil assembly of claim 1 wherein the first portion is defined by four sides, and the second portion extends from only two of the four sides.

10. The voice coil assembly of claim 1 further comprising:

a gusset between the first portion and the second portion, wherein the gusset is dimensioned to geometrically stiffen the voice coil former.

11. The voice coil assembly of claim 1 further comprising:

a stiffening plate positioned on the first portion.

12. The voice coil assembly of claim 1 wherein the first portion and the second portion are formed from a same sheet of material.

13. A high aspect ratio voice coil assembly comprising:

a voice coil former having a sound radiating portion and a sidewall extending perpendicular to a plane of the sound radiating portion for positioning of a high aspect ratio voice coil thereon, the sound radiating portion being integrally formed with the sidewall; and a stiffening member integrally formed with the voice coil former from a same sheet of material.

14. The high aspect ratio voice coil assembly of claim 13 wherein the voice coil comprises an aspect ratio of at least 3.0.

15. The high aspect ratio voice coil assembly of claim 13 wherein an angle formed between the sound radiating portion and the sidewall is ninety degrees or less.

16. The high aspect ratio voice coil assembly of claim 13 wherein the sound radiating portion comprises a planar region that is entirely within the plane of the sound radiating portion, and the stiffening member comprises an out-of-plane region that protrudes outside the plane of the planar region and is surrounded by the planar region.

17. The high aspect ratio voice coil assembly of claim 13 wherein the stiffening member comprises a hem formed at an end of the sidewall, and the hem is dimensioned to geometrically stiffen the voice coil former.

18. The high aspect ratio voice coil assembly of claim 13 further comprising a plurality of indentations formed within adjoining portions of the sound radiating portion and the sidewall.

19. The high aspect ratio voice coil assembly of claim 13 wherein the sidewall comprises at least one opening that extends through the sidewall.

20. The high aspect ratio voice coil assembly of claim 13 wherein a material of the sound radiating portion, the sidewall and the stiffening member comprises aluminum, titanium, stainless steel or carbon fiber.

21. The high aspect ratio voice coil assembly of claim 13 further comprising:

a frame;

a magnet assembly coupled to the frame, wherein the former is suspended from the frame by a suspension member and positioned over the magnet assembly; and the voice coil is positioned around the sidewall of the voice coil former.

22. The high aspect ratio voice coil assembly of claim 13 wherein a length of the stiffening member is parallel to a length of the sound radiating portion.

* * * * *